US005626912A

United States Patent [19]

Hendrix et al.

[11] Patent Number: 5,626,912

[45] Date of Patent: May 6, 1997

[54] TUFTED FABRICS

[75] Inventors: Jan A. J. Hendrix, Born; Arnoldus M. Kerssemakers, Valkenburg a/d Geul, both of Netherlands; Yousef Mohajer, Midlothian; Forrest E. Sloan, Chesterfield, both of Va.

[73] Assignees: DSM N.V., Netherlands; AlliedSignal Inc., Morristown, N.J.

[21] Appl. No.: 422,527

[22] Filed: Apr. 14, 1995

[51] Int. Cl.[6] ..... B05D 3/02; B05D 5/00

[52] U.S. Cl. ..... 427/288; 156/77; 156/291; 427/342; 427/389.9; 428/85

[58] Field of Search ..... 427/342, 389.9, 427/393.5, 288; 156/77, 291; 428/85

[56] References Cited

U.S. PATENT DOCUMENTS

| | | | |
|---|---|---|---|
| 3,083,118 | 3/1963 | Bridgeford | 427/342 X |
| 4,978,402 | 12/1990 | Hallworth | 427/288 X |

FOREIGN PATENT DOCUMENTS 10508287 10/1992 European Pat. Off. .

*Primary Examiner*—Michael Lusignan
*Attorney, Agent, or Firm*—Cushman Darby & Cushman IP Group Of Pillsbury Madison & Sutro, LLP

[57] ABSTRACT

The present invention relates to a tufted fabric and a method of manufacturing the same. The tufted fabric generally comprises a primary backing and tufts mounted in the primary backing to form a fabric with a faceside having piles and a backside having loops. A thermoplastic polymer adhesive, which bonds the tufts to the primary backing, is formed by applying a reactive mixture comprising a polymerizable monomer to the backside of the tufted fabric and in-situ polymerizing the monomers to form the thermoplastic polymer adhesive. The process is particularly advantageous for the manufacture of recyclable tufted fabrics in which the adhesive polymer and tufts are formed from substantially the same polymer. The tufted fabric can be used in articles, such as, for example carpets, rugs and upholstery.

14 Claims, 2 Drawing Sheets

TUFTED FABRICS

BACKGROUND OF THE INVENTION

1. Field of Invention

The present invention pertains to tufted fabrics useful in the manufacture of articles such as, for example, carpets, rugs, and upholstery. More specifically, the present invention is directed to a process for manufacturing tufted fabrics, especially recyclable fabrics, which comprise a primary backing having tufts mounted therein.

2. Description of Related Art

An overview of the present technological developments with respect to the application of thermoplastic polymer adhesives to textile substrates is disclosed, for instance, in Textile World, Chemical Treatment & Finishing, February 1994, page 87 to 89. This article discloses that the increasing demand to operate at higher production rates has resulted in changes to the method by which tufted fabrics are manufactured. More specifically, these changes are characterized by the replacement of solvent-born adhesives with thermoplastic polymer (hot-melt) adhesives.

Processes employing solvent-born adhesives are considered disadvantageous inasmuch as they require large drying ovens and involve extended drying times, thereby lowering production rates. By contrast, hot-melt adhesives have a relatively short setting time and hence allow for higher production rates.

The hot-melt process is characterized by the mounting of tufts in a primary backing, followed by the application of a hot-melt adhesive to the backside of the primary backing so as to form the tufted fabric. Although the use of hot-melt adhesives allow for higher production rates, it has been noted that hot-melt adhesives also exhibit several disadvantages. For example, hot-melt adhesives can only be applied to textile fabrics at high temperatures, well above the melting temperature of the adhesive polymer. Because tufted fabric materials are often unstable at such high temperatures, the exposure of a textile fabric to the temperatures associated with the hot-melt process can result in considerable thermal shrinkage to the textile fabric. The mechanical properties of the fabric can thereby be permanently damaged. Accordingly, the hot-melt adhesive method is considered impractical or even unacceptable for several fabrics. In particular, textile fabrics formed from materials having a melting or softening temperature close to the temperature at which the hot-melt adhesive is applied cannot be effectively produced by the hot-melt adhesive method.

A further disadvantage of hot-melt adhesives is that many polymers that are otherwise suitable as adhesives are chemically unstable, sensitive to oxidation, or very hygroscopic at temperatures above their melting temperature. Accordingly, such adhesive polymers can only be applied by employing expensive closed methods such as die extrusion, in which a film of adhesive polymer is extruded and applied to the backside of a textile fabric.

In addition, hot-melt adhesives often have an undesirably high viscosity, thereby producing poor wetting properties. High wetting results in poor bonding between tufts and the primary backing and poor mutual bonding between the fibers in the tufts. The resulting tufted fabrics are sensitive to abrasive forces and have an undesirably low life-span. Consequently, these adhesives are considered unsuitable for many production processes.

The aforementioned disadvantages associated with hot-melt adhesives are especially problematic in the manufacture of tufted fabrics having an adhesive polymer formed from substantially the same polymer as the tufts and/or the backing. Such tufted fabrics are of great interest because of their attractiveness for recycling purposes.

For example, EP-A 0.508.287 discloses a recyclable tufted carpet in which the tufts and the primary backing consist of polyamide 6. The tufts are bonded to the primary backing by applying a polyamide 6 in the form of a film or powder, heated above the melting temperature, to the backside of the tufted fabric. Because the tufts are formed from substantially the same polymer as the adhesive polymer, the melting temperatures of the tufts and adhesive polymer are substantially similar. Thus, a serious risk arises of melting the tufts and the primary backing, thereby adversely affecting the mechanical properties of the tufted fabric.

The particular polyamide film and powder disclosed in the above-cited reference respectively present additional problems. For example, the polymer powder, which must have a small particle size, is very expensive. The polyamide film is applied to the tufted fabric in such a manner that excess film is present in interstitial spaces between the tufts, thereby increasing the weight of the tuft fabric without significantly contributing to the binding of the tufts. Further, the flexibility and the dimensional stability of the tufted fabric is poor. As defined herein, "dimensional stability" refers hereinafter to the extent to which dimensional changes (e.g., shrinkage) occur upon exposure to changing ambient conditions (e.g., air relative humidity and temperature).

EP-A 0.508.287 further suggests applying a copolyamide (as opposed to a polyamide) thermoplastic polymer adhesive to decrease the melting temperature of the adhesive, thereby avoiding such problems as thermal degradation and shrinkage. However, application of a copolymer is disadvantageous inasmuch as copolymers contain a substantial amount of different (co)monomers. For example, about 30 to 40% of the copolyamide must be represented by a different (co) monomer in order to depress the melting temperature of polyamide 6 about 40° C. Including such large amounts of a different (co)monomer also contradicts the primary objective in the field of recyclable tufted fabrics—i.e., an increase in yield of monomer recoverable upon recycling. Moreover, copolyamides have a relatively high viscosity and hence poor wetting properties.

SUMMARY OF THE INVENTION

Accordingly, it is an object of the present invention to provide a process for forming tufted fabrics that overcomes the aforementioned problems associated with the solvent-born and hot-melt adhesives.

It is another object of the present invention to provide a process that affords production rates of tufted fibers that are considerably higher than those of processes involving solvent-born adhesives.

It is still another object of the present invention to provide a process that is solvent-free to eliminate the emission of environmentally harmful solvents.

It is a further object of the present invention to provide a process that is particularly advantageous for manufacturing recyclable tufted fabrics in which the tufts and/or primary backing are formed from a polymer which is substantially chemically similar to the adhesive polymer.

It is still a further object of the present invention to provide a process that is useful for the manufacture of various tufted fabrics, including fabrics useful for carpets, rugs, and upholstery.

To accomplish these and other objectives, the present invention provides a method for forming a tufted fabric that comprises the steps of applying a reactive mixture comprising a polymerizable monomer to the backside of the tufted fabric and in-situ polymerizing the monomer to form the thermoplastic polymer adhesive. The adhesive thereby bonds the tufts to the primary backing. Because the polymerization temperature is considerably lower than the melting temperature of the adhesive, the temperature to which the tufted fabric is exposed is correspondingly lower than in processes involving hot-melt adhesives.

These and other objects, features, and advantages of the present invention will become apparent from the following detailed description, which when taken in conjunction with the accompanying drawings, illustrate, by way of example, the principles of the present invention.

BRIEF DESCRIPTION OF THE DRAWING

The accompanying drawings illustrate an embodiment of the present invention. In such drawings.

DESCRIPTION OF THE PREFERRED EMBODIMENTS

A detailed description of the present invention is provided below.

Figure 1:
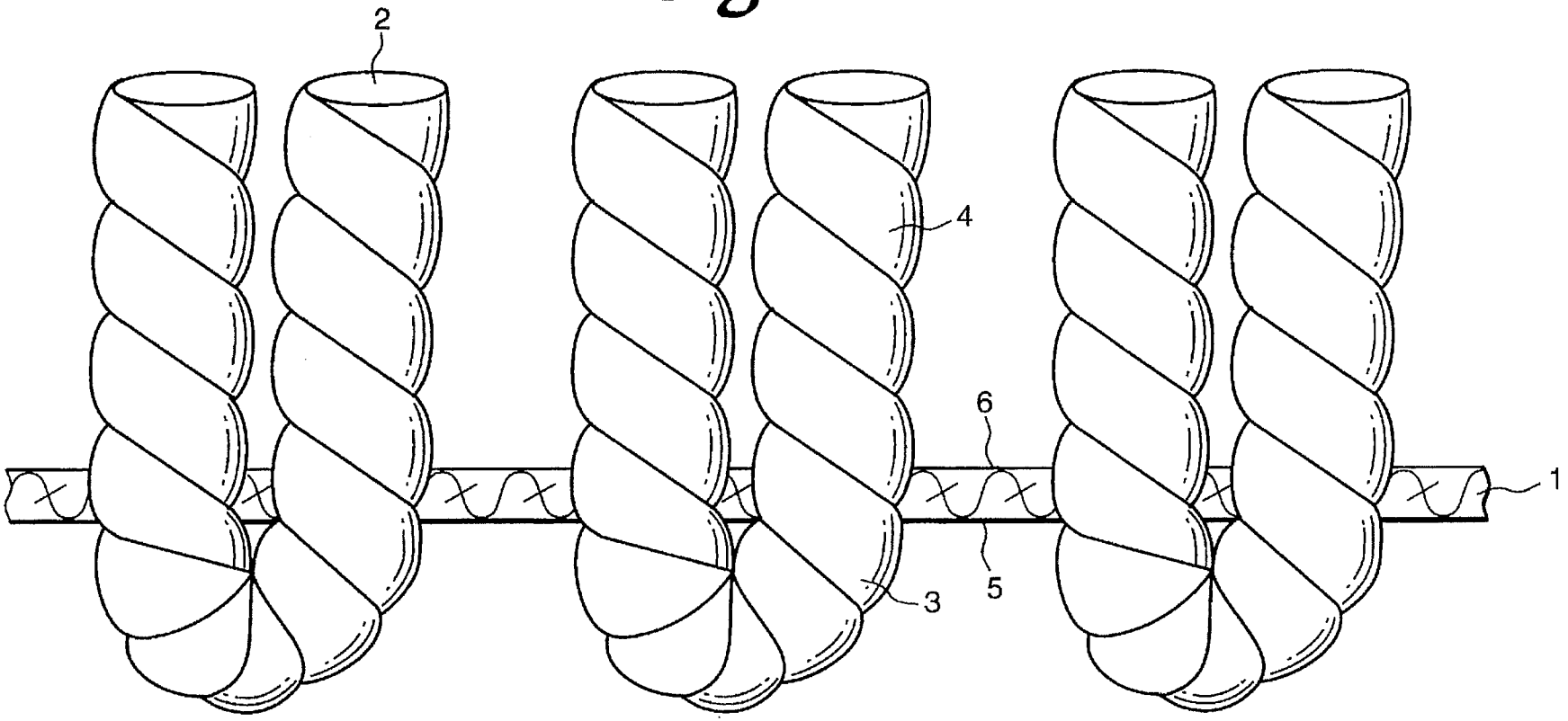
FIG. 1 shows a cross-sectional view of a tufted fabric before impregnation according to an embodiment of the present invention.

As shown in FIG. 1, a tufted fabric generally comprises a primary backing 1 and tufts 2 mounted through the primary backing. The primary backing (substrate) serves as a support for the tufts and provides mechanical strength to the tufted fabric. Exemplary primary backings include woven or knitted fabric, felt, film, or any combination thereof. Each of these examples possesses specific advantages that are well known in the art of tufted fabrics.

Tufts are made of fibers. Generally, the fibers are either in continuous-filament or staple-fiber form and can be assembled in a yarn or a roving. A variety of methods are known for mounting the tufts in the primary backing. For example, the tufts can be mounted by needle-punching fibers through the primary backing or by "tufting" yarns or rovings through the primary backing. After mounting the tufts in the primary backing according to the above-described methods, the tufts are defined by loops 3 extending from one surface (i.e., the backside surface 5) and piles 4 extending from the opposite surface (i.e., faceside surface 6) of the primary backing. The piles can take the form of loops (loop-pile), or can be manipulated to form cut-open loops (cut-pile).

Figure 2:
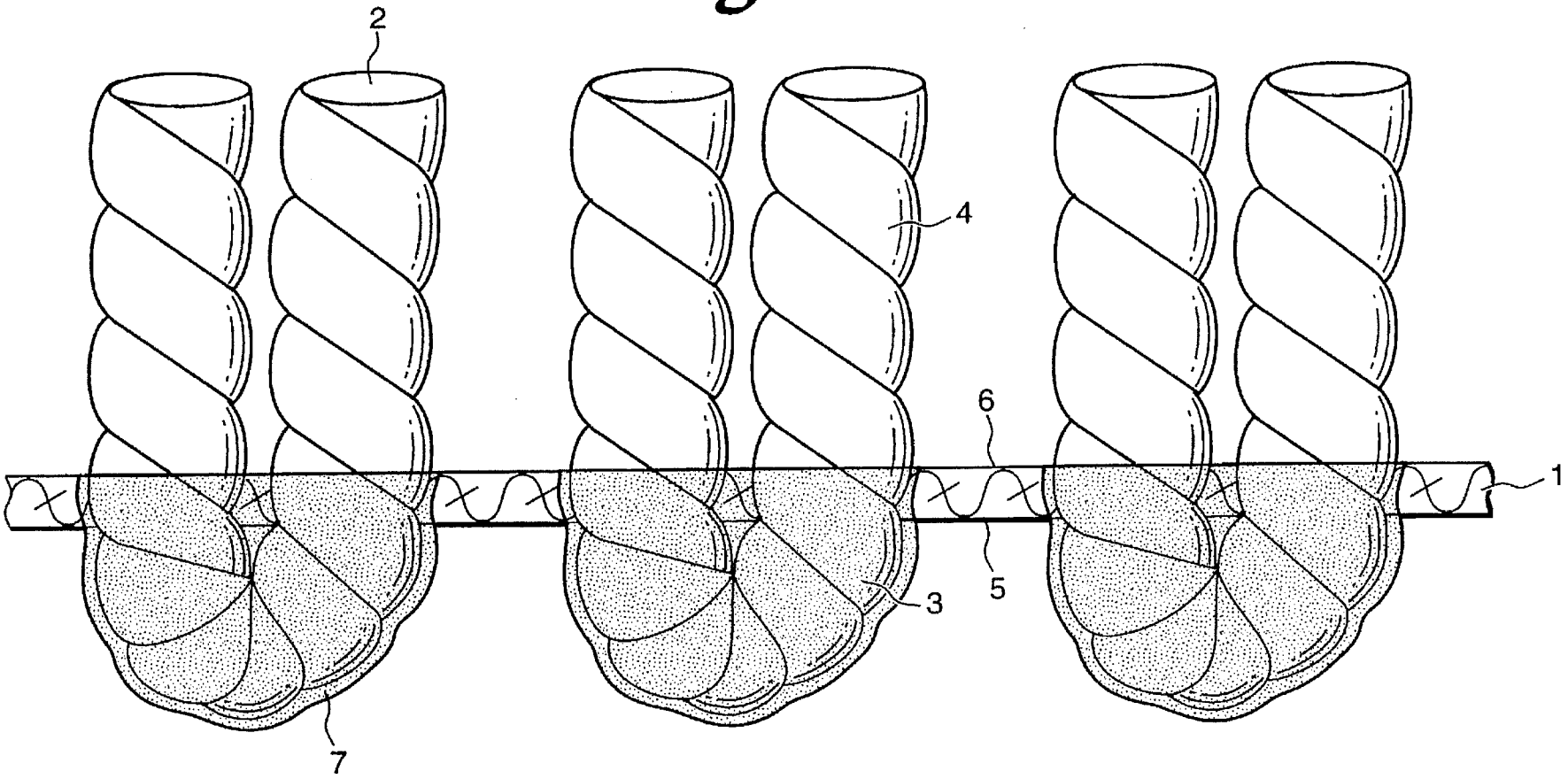
FIG. 2 shows a cross-sectional view of a tufted fabric after impregnation according to an embodiment of the present invention.

According to the method provided by the present invention and as shown in FIG. 2, after being mounted on the primary backing, the tufts are secured and bound thereto by an applied reactive mixture 7 comprising a monomeric precursor to the backside of the primary backing (and the loops of the tufts) and then in-situ polymerizing the precursor to form the thermoplastic polymer adhesive. The monomeric precursor is defined herein as including a monomer or an oligomer of the monomer. The reactive mixture can comprise a mixture of different monomeric precursors. The monomeric precursors are selected in view of the desired properties of the resulting thermoplastic polymer adhesive.

Preferably, the viscosity of the reactive mixture during application is between about 0.02 (Pa)(sec) and about 10 (Pa)(sec). For the purposes of the present invention, the viscosity of the reactive mixture is measured by dynamic viscometry at the moment and temperature that the reaction mixture is applied to the tufted fabric. The viscosity is preferably above about 0.02 (Pa)(sec) in order to prevent the reactive mixture from leaking through the primary backing and penetrating (via capillary forces between the fibers of the tufts) into the piles at the faceside of the tufted fabric. The viscosity is preferably lower than about 10 (Pa)(sec) in order to avoid poor wetting of the loops of the tufts. More preferably, the viscosity of the reactive mixture is between about 0.05 (Pa)(sec) and about 5 (Pa)(sec). Viscosities between about 0.1 (Pa)(sec) and about 2 (Pa)(sec) are particularly favorable inasmuch as a very good impregnation of the reactive mixture in between the tuft fibers is obtained, resulting in both excellent mutual bonding between the tuft fibers and good bonding between the tufts and the primary backing.

Where a reactive mixture comprising monomers possesses an undesirably low viscosity, the viscosity can be increased by including viscosity increasing substances (viscosifiers) in the reactive mixture. Preferred viscosifiers are oligomers which are formed, at least in part, of the same monomer as comprised in the reactive mixture. The advantage of including such oligomers in the reactive mixture is that the oligomers can be incorporated in the polymer during polymerization and can also be recovered upon recycling. The appropriate amount and molecular weight of the oligomer can be determined by routine experimentation.

The viscosity of the reactive mixture can also be increased by performing a partial prepolymerization, e.g., conducting the polymerization step for a short controlled time span before applying the partially polymerized but still reactive mixture to the tufted fabric. The time span and temperature required to reach the desired viscosity level is also determinable by routine experimentation.

The monomeric precursor can be selected in view of the desired composition of the adhesive polymer. Exemplary adhesive polymers include polyesters, polyamides, or polyolefins formed by anionic or cationic polymerization of respective lactones, lactams, or conjugated olefins as the selected monomeric precursor. Another exemplary adhesive polymer is a polyamide formed by condensation polymerization. The adhesive polymer can also be, by way of example, cured by radical polymerization initiated chemically (e.g., by peroxides) or physically (e.g., by ultra-violet radiation).

Preferably, the monomeric precursor is polymerized by anionic polymerization or by radical polymerization. These polymerization reactions are fast, thus allowing higher production rates in the manufacture of the tufted fabric. Furthermore, such polymerization reactions proceed at low temperatures in comparison to hot-melt adhesives, and do not emit harmful organic pollutants and other undesirable emissions to the environment.

The monomeric precursor is preferably a lactam and, consequently, the adhesive polymer is a polyamide. More preferably, the lactam has between about 5 and about 14 ring atoms, such as γ-pyrrolidone, ε-caprolactam, C-substituted caprolactam, capryllactam, laurinolactam, or any combination thereof. The polyamide formed from such lactams is advantageous inasmuch as it can easily be depolymerized to the lactam upon recycling. Most preferably, the reactive mixture comprises caprolactam as the amide precursor, an anionic polymerization catalyst, and an activator. The particular advantages of this reactive mixture include its high polymerization rate, relatively low polymerization temperature, high degree of conversion, and good wetting properties.

Exemplary catalysts include, but are not limited to, lactam magnesium halides, magnesium bislactamates, alkali metal or earth alkali metal adducts of lactam (e.g. sodium, potassium, and lithium lactamates), aluminum or magnesium lactam with added magnesium bromide, alkoxides, and the like. Preferably sodium lactamate is used as the catalyst because of its high catalytic activity. In particular, sodium caprolactamate is preferably used for the polymerization of caprolactam. The catalyst is present in an amount between about 0.001 to about 3 mol per kilo reactive mixture, preferably between about 0.01 and about 2 mol per kilo reactive mixture, and most preferably between about 0.01 and about 0.15 mol per kilo reactive mixture.

Exemplary activators include, but are not limited to, carbamoyllactamates (in particular blocked isocyanates or polyisocyanates), acyllactamates (in particular adipoyllactams, isophtaloylbislactamates or terephtaloylbislactamates), esters (in particular dimethylphtalate-polyethylene glycol), prepolymers of polyetherpolyols, polydienepolyols, polyetherpolyamines, or polydienepolyamines in combination with bis-acid chlorides, carbonylbislactamates, or phosphoryl activators. Preferably, carbamoyllactamates are selected as the activator. The activator is preferably present in an amount between about 0.001 to about 3 mol per kilo reactive mixture, more preferably between about 0.01 and about 2 mol per kilo reactive mixture, and most preferably between about 0.01 and about 0.15 mol per kilo reactive mixture.

Preferred activator/catalyst combinations include a lactam blocked polyisocyanate activator with an alkali metal lactamate catalyst, and an acyllactamate activator with an alkaline earth metal lactamate catalyst.

It has been found that in circumstances where it is not desired or is even impossible to adequately control the moisture content of the reactive mixture or of the substrate lactam alkalimetal-aluminum lactamate (in particular sodium-aluminum lactamate), a lactam magnesium halide/magnesium bislactamate mixture can be advantageously used as the catalyst. This mixture is less sensitive to water and remains active even if the lactam has taken up a considerable amount of water.

The reactive mixture can further include one or more customary additives. Exemplary additives include viscosity modifiers, polymerization aids such as catalysts and activators (e.g., the above-mentioned catalysts and activators), processing aids, pigments, flame retardants, stabilizers, antistatics, and the like. More particularly, representative viscosity modifiers include finely divided minerals (e.g., silica, aluminiumoxide, and magnesiumoxide); salts of, for example, lactamates or ω-aminoacid salts of barium, calcium, or strontium); oligomers such as, for example, oligomers of caprolactam; and soluble polymers such as, for example, copolymers of acrylonitril and butadiene, copolymers of styrene and butadiene, polyoxyalkylenes, polyvinylalcohol, polyacrylic acid, polyacrylamide, poly (alkyloxazoline), and poly-N-vinyllactam. In principle, suitable UV-stabilizers include 2-hydroxy-4-alkoxy benzophenone, ester of 2',4'-di-t-butylphenyl benzoic acid and 3,5-di-t-butyl-4-hydroxide, 2(2'-hydroxy- 3', 5'-di-t-butylphenyl)-5-chlorobenzotriazole, and 2(2'-hydroxy-3', 5'-di-t-butylphenyl) benzotriazole. Potassiumformiate and carbon black can, in principal, be used as antistatics. In principal, suitable additives include antioxidants such as 2,6-di-t-butylphenol and copper (I) iodide/potassium iodide. Representative flame retardants are red phosphorous; inorganic hydroxides such as aluminum-trihydroxide and magnesiumhydroxide; halogen-containing chemicals such as polydibrome-phenyleneoxide, octabrome-diphenyloxide, ethylene-bis (5,6-dibromo-norbornane-2,3-dicarboxamide), and ethylene-bis(tetrabrome-phtalimide); and synergists used in combination with halogen-containing chemicals such as antimony (III) oxide.

In view of the desired recyclability of the tufted fabric, the composition of monomeric precursors in the reactive mixture is selected to preferably closely chemically correspond to the composition of the polymer of the tufts. The adhesive polymer preferably is comprised of at least about 70% by weight, more preferably at least about 80% by weight, and most preferably at least about 90% by weight, the monomer or monomers that predominantly constitute the polymer of the tufts. In a most preferred embodiment, the tufts and the adhesive polymer consist essentially of polyamide 6, which has excellent properties for application in tufted fabrics (e.g., carpets, rugs, upholstery) and can easily be depolymerized for recycling. However, it is understood that the present invention is not limited to this most preferred embodiment. For example, according to the present invention the tufted fabric can include polyamide-6 tufts and polyamide-8 adhesive.

In the process according to the present invention, the reactive mixture can be applied in any suitable manner for evenly distributing the mixture over a surface. The good wetting properties of the reactive mixture provides the tufts with a sufficient binding strength even when the bonding is substantially exclusively present between the tufts and the primary backing. In a preferred embodiment, the reactive mixture is applied substantially only to the loops of the tufts. The advantage of this preferred embodiment is that the resulting tufted fabric has an even higher flexibility, a higher dimensional stability, and a lower weight. The loops extend a sufficient distance from the backside surface of the primary backing so as to allow only the loops to be wetted. The loops can be wetted by contacting them from below, for example, by rolling the backside surface of the tufted fabric over a divider roll upon which a liquid film of the reactive mixture is provided. Due to its low viscosity and to capillary forces, the reactive mixture is absorbed into the loops of the tufts. The reactive mixture can penetrate to a certain extent into the tuft on the faceside (the pile), such that the interstices between the fibers in the tuft loops and the interstices between the tufts and the primary backing are substantially filled. The space between the neighboring loops is depleted with reactive mixture. However, the tufts do not become totally impregnated. In practice, the extent of impregnation should be regulated to produce a fabric having a desired feel (e.g., softness) and weight.

Alternatively, wetting can be achieved by spraying the reaction mixture onto the backside of the tufted fabric or by pick-up from a reservoir. Because the reactive mixture is applied to the backside surface of the tufted fabric, the risk of the reactive mixture leaking through the primary backing is avoided, even for reactive mixtures of very low viscosities.

In comparison with hot-melt adhesives, the present invention requires less adhesive to obtain a sufficient binding strength due to the preferential absorption of the reactive mixture into the loops. Hence, tufted fabrics obtained by the process of the present invention have a higher flexibility, a higher dimensional stability, and a lower weight than conventional fabrics. The lower weight of the tufted fabric is advantageous in reducing costs, especially costs associated with the shipping and transporting of the tufted fabric. Such cost reduction is particularly desired in fields relating to, for example, automotive applications.

The polymerization of the reactive mixture is performed in-situ—that is, after application of the reactive mixture to the tufted fabric. Polymerization is defined as including the formation of a polymer, but excludes the initial polymerization of monomer precursors to oligomers for the purpose of increasing the viscosity of the reactive mixture to the desired level (as described above). By way of example, the polymerization reaction can be initiated by mixing the monomeric precursor with an initiator (e.g., a catalyst and/or activator), and/or by raising the temperature, or by any other means suitable for the particular polymerization reaction of the monomeric precursor.

The polymerization temperature of the reactive mixture should be kept below the melting or decomposition temperature of the tufted material. More specifically, the polymerization temperature should preferably be 10° C., more preferably at least about 20° C., even more preferably at least about 30° C., and most preferably at least about 50° C., below the melting temperature of the resulting thermoplastic polymer adhesive. For example, the in-situ polymerization of the reactive mixture comprising caprolactam is preferably conducted at a temperature between about 120° C. and about 220° C., more preferably between about 130° C. and about 200° C., and most preferably between about 130° C. and about 170° C.

A further advantage of the process of the present invention is that the monomeric precursor can be polymerized to form a polymer adhesive having a molecular weight that is significantly higher than the molecular weight of hot-melt adhesives or solvent-borne adhesives. A higher molecular weight polymer is advantageous inasmuch as the abrasion resistance of the adhesive and the tuft loops in which the adhesive is absorbed is greater. Preferably the adhesive has a molecular weight of at least about 5,000 g/mol, more preferably at least about 10,000 g/mol, even more preferably at least about 15,000 g/mol, and most preferably at least about 25,000 g/mol. However, the molecular weight depends on the particular monomer selected. For example, it is possible to produce polyamide-6 with a molecular weight of at least 6,000,000 g/mol. It is presently believed that the molecular weight is not determinative of the adhesive strength.

The present invention further relates to tufted fabrics formed according to the above-described process. Such tufted fabrics have several advantages over conventional tufted fabrics obtained by conventional hot-melt or solvent-born adhesive methods. For example, when the thermoplastic polymer adhesive is impregnated into the tufts and has a molecular weight of at least about 5,000 g/mol, the bonding of the tufts in the tufted fabric, and in particular the mutual bonding of the fibers in the tufts, is much improved. Consequently the tufted fabric according to the invention is less sensitive to abrasive forces and has a longer useful life-span. The tuft pull-out strength is preferably at least about 10 lbs., more preferably at least about 15 lbs., and most preferably at least about 20 lbs. as measured according to ASTM D13356-72. As defined by this standard, pull-out strength is the force required to pull a tuft completely out of a cut pile floor covering or to pull one or both legs of a loop free from the backing of looped pile floor covering.

The thermoplastic polymer adhesive is preferentially impregnated into the loops of the tufts. A tufted fabric so impregnated in accordance with the present invention is advantageous in that a comparable bonding strength can be achieved with less adhesive, thereby resulting in fabric having a lower weight and an improved flexibility and dimensional stability. The dimensional changes are preferably less than about 1%, more preferably less than about 0.5%, and most preferably less than about 0.1%.

In the present invention, the monomeric precursor can, if desired, be polymerized in-situ-substantially only to the tufts. Because less adhesive is required to achieve a sufficient bonding strength, a tufted fabric also provides an advantageous flexibility and dimensional stability.

The primary backing, the tufts, and the adhesive can be made of substantially the same polymer material. The advantage of such a tufted fabric is that the tufted fabric is more attractive for recycling applications.

As described above, a major advantage of the process of the present invention is that it allows for the use materials in the tufted fabric that have a melting temperature that is equal to or less than the melting temperature of the adhesive. Accordingly, the primary backing can be selected from a material that is different than the material from which the adhesive and the tufts are formed. For example, the primary backing can be polypropylene, which is relatively inexpensive and provides a better dimensional stability than the fabrics disclosed in EP-A 0,508,287.

The present invention is further described in the following non-limiting Example.

EXAMPLES

Example I

A reactive mixture consisting of 500 parts by weight (pbw) of caprolactam, 10.7 pbw of caprolactam blocked 1,6 hexane-diisocyanate (as the activator), and 7.3 pbw of sodium-caprolactamate (as the catalyst) was heated at 150° C. for 20 seconds. The viscosity of the mixture was then measured to be 1.1 (Pa)(sec) (as established at 150° C. by means of a parallel plate viscosimeter, plate diameter 2.5 cm, distance 1 mm, deformation 4 mrad, frequency 1 Hz). The backside of an unbacked carpet, consisting of a polyester primary backing and nylon-6 tufts, was dipped into the reactive mixture for 0.5 second. After removal of the carpet from the pool of reactive mixture, the carpet was heated at 140° C. for 5 minutes to polymerize the reactive mixture on the backside of the carpet to nylon-6. The above-cited steps were performed under dry nitrogen conditions. The tuft pull-out strength (measured according to ASTM D1335-72) of the carpet was 23.6 lbs.

The cross-section of the treated carpet showed that the adhesive (anionic nylon-6) was impregnated into the loops of the tufts and in the portion of the primary backing directly surrounding the tufts.

Although the present invention has been described in detail with reference to its presently preferred embodiments, it will be understood by those of ordinary skill in the art that various modifications and improvements to the present invention are believed to be apparent to one skilled in the art. Accordingly, no limitation upon the invention is intended, except as set forth in the appended claims.

What is claimed is:

1. A process for forming a tufted fabric comprising the steps of:

mounting tufts in a primary backing having a faceside and a backside, said tufts forming piles at said faceside and loops at said backside of said primary backing;

applying a reactive mixture to at least said loops on said backside of said primary backing, said reactive mixture comprising a polymerizable monomer; and in-situ polymerizing said monomer to obtain a thermoplastic polymer adhesive, said thermoplastic polymer adhesive binding said tufts to said primary backing.

2. A process according to claim 1, wherein said reactive mixture is applied to said backside of said tufted fabric with a viscosity of between about 0.02 (Pa)(sec) and about 10 (Pa) (sec).

3. A process according to claim 1, wherein said reactive mixture is applied to said backside of said tufted fabric with a viscosity of between about 0.1 (Pa)(sec) and about 2 (Pa)(sec).

4. A process according to claim 1 or 2, wherein said step of in-situ polymerizing is conducted at a temperature below the melting temperature of said tufts.

5. A process according to claim 4, wherein said tufts and said polymer adhesive comprise substantially the same polymer.

6. A process according to claim 5, wherein said tufts and said polymer adhesive after in-situ polymerization consist essentially of polyamide 6.

7. A process according to claim 5, wherein said reactive mixture comprises caprolactam as said monomer, an anionic polymerization catalyst, and an activator.

8. A process according to claim 7, wherein said anionic polymerization catalyst is sodium-aluminum lactamate or a mixture of a lactam magnesium halide and magnesium bislactamate.

9. A process according to claim 4, wherein said polymer adhesive has a weight average molecular weight of at least about 5000 g/mol.

10. A process according to claim 4, wherein said reactive mixture further comprises a lactam blocked polyisocyanate activator and an alkali metal lactamate catalyst.

11. A process according to claim 4, wherein said reactive mixture further comprises an acyllactamate activator and an alkaline earth metal lactamate catalyst.

12. A process according to claim 1, wherein said thermoplastic polymer adhesive is meltable and recyclable.

13. A process according to claim 1, wherein said reactive mixture is prepared prior to said applying step.

14. A process according to claim 1, wherein said applying step comprises dipping said loops on said backside of said primary backing into said reactive mixture.

* * * * *